US011213085B1

(12) United States Patent
Adamski et al.

(10) Patent No.: US 11,213,085 B1
(45) Date of Patent: Jan. 4, 2022

(54) ACCENT FEATHER HOLDER FOR PLUME SOCKET CUP AND METHOD OF USING SAME

(71) Applicant: Demoulin Brothers & Company, Greenville, IL (US)

(72) Inventors: Donald R. Adamski, Greenville, IL (US); Jeff Huang, Guangdong (CN)

(73) Assignee: DEMOULIN BROTHERS & COMPANY, Greenville, IL (US)

( * ) Notice: Subject to any disclaimer, the term of this patent is extended or adjusted under 35 U.S.C. 154(b) by 114 days.

(21) Appl. No.: 16/809,009

(22) Filed: Mar. 4, 2020

(51) Int. Cl.

| | |
|---|---|
| ***A41G 11/00*** | (2006.01) |
| ***A42B 1/004*** | (2021.01) |
| ***A42B 1/24*** | (2021.01) |
| *A45F 5/00* | (2006.01) |

(52) U.S. Cl.
CPC ..... *A42B 1/004* (2013.01); *A42B 1/24* (2013.01); *A41G 11/00* (2013.01); *A45F 5/00* (2013.01)

(58) Field of Classification Search
CPC ..... A42B 1/004; A42B 1/24; A41G 11/00; A45F 5/00; A45F 5/08; A45F 2005/023; B23P 19/04
See application file for complete search history.

(56) References Cited

U.S. PATENT DOCUMENTS

| | | | | |
|---|---|---|---|---|
| 40,404 | A | 10/1863 | Schwalb | |
| 238,611 | A | 3/1881 | Ryder | |
| 241,201 | A | 5/1881 | Fautz | |
| 314,426 | A * | 3/1885 | Cardell | A45F 5/08 24/5 |
| 456,745 | A | 7/1891 | Tyrrel | |
| 771,693 | A | 10/1904 | Apthorp | |
| 1,077,653 | A | 11/1913 | Tisne | |
| 1,155,428 | A | 10/1915 | Lynch | |
| 1,221,867 | A | 4/1917 | Keller | |
| 1,425,480 | A | 8/1922 | Hoffmann | |
| 2,721,410 | A | 10/1955 | Davis | |
| 2,829,376 | A | 4/1958 | Ostwald | |
| 2003/0222189 | A1* | 12/2003 | Lee | A63B 57/20 248/302 |
| 2009/0025310 | A1* | 1/2009 | Harris | A01M 29/34 52/101 |
| 2009/0277072 | A1* | 11/2009 | Fergus | A01K 85/08 43/42.25 |
| 2013/0042388 | A1 | 2/2013 | Lasko et al. | |
| 2014/0053372 | A1* | 2/2014 | Jacobson | A44B 13/00 24/300 |

* cited by examiner

*Primary Examiner* — Robert Sandy
*Assistant Examiner* — Rowland Do
(74) *Attorney, Agent, or Firm* — Thompson Coburn LLP

(57) ABSTRACT

A holder for a feather has a coil portion. The coil portion has a center axis, an exterior, and an interior. The interior of the coil portion is configured to receive a shaft of the feather inserted into the coil portion along the center axis. The holder has a socket cup connector portion extending from the coil portion. The socket cup connector portion has an inner leg having a first region extending axially relative to the coil portion, and a second region extending in a direction away from the inner leg first region and away from the exterior of the coil portion. The inner leg first region is spaced from the exterior of the coil portion at a distance such that the inner leg first region and the exterior of the coil portion are resiliently engageable with a wall of a socket cup when the holder is releasably attached to the socket cup.

6 Claims, 7 Drawing Sheets

ACCENT FEATHER HOLDER FOR PLUME SOCKET CUP AND METHOD OF USING SAME

BACKGROUND AND SUMMARY

The disclosure is directed to a holder for an accent feather. The holder may be releasably attached to a conventional socket cup that is configured to hold a conventional plume. The socket cup may be releasably attached to decorative hat, for instance, a shako, as is known in the art. The holder has a coil portion with an interior adapted to springingly engage a shaft of the accent feather. The holder has a socket cup connector portion that works with the coil portion to resiliently and releasably engage a wall of the socket cup.

DETAILED DESCRIPTION

Figure 1:
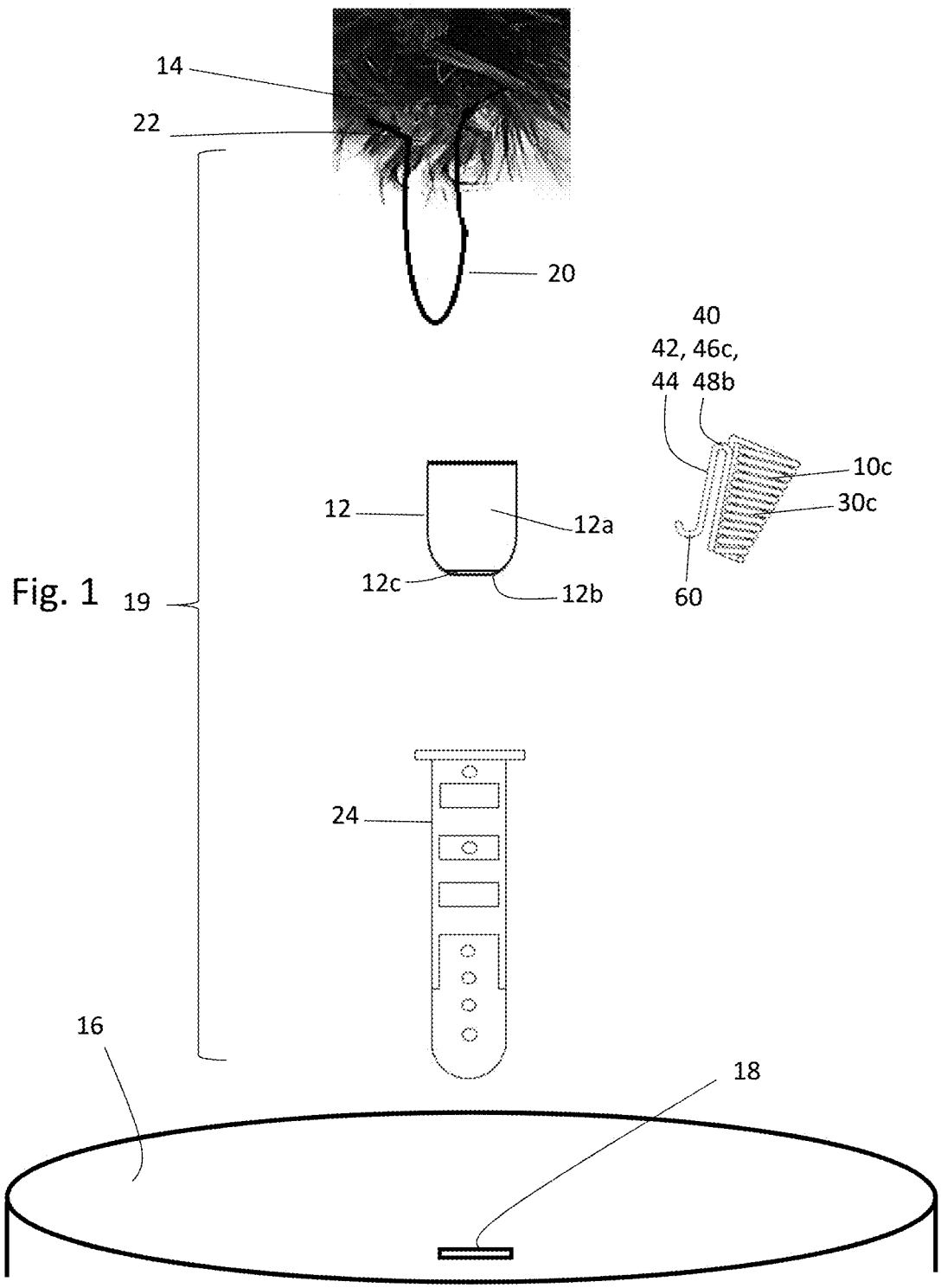
FIG. 1 an exploded view of an anchoring assembly used to secure the socket cup and plume to a decorative hat, and including an exemplary holder.
Figure 7:
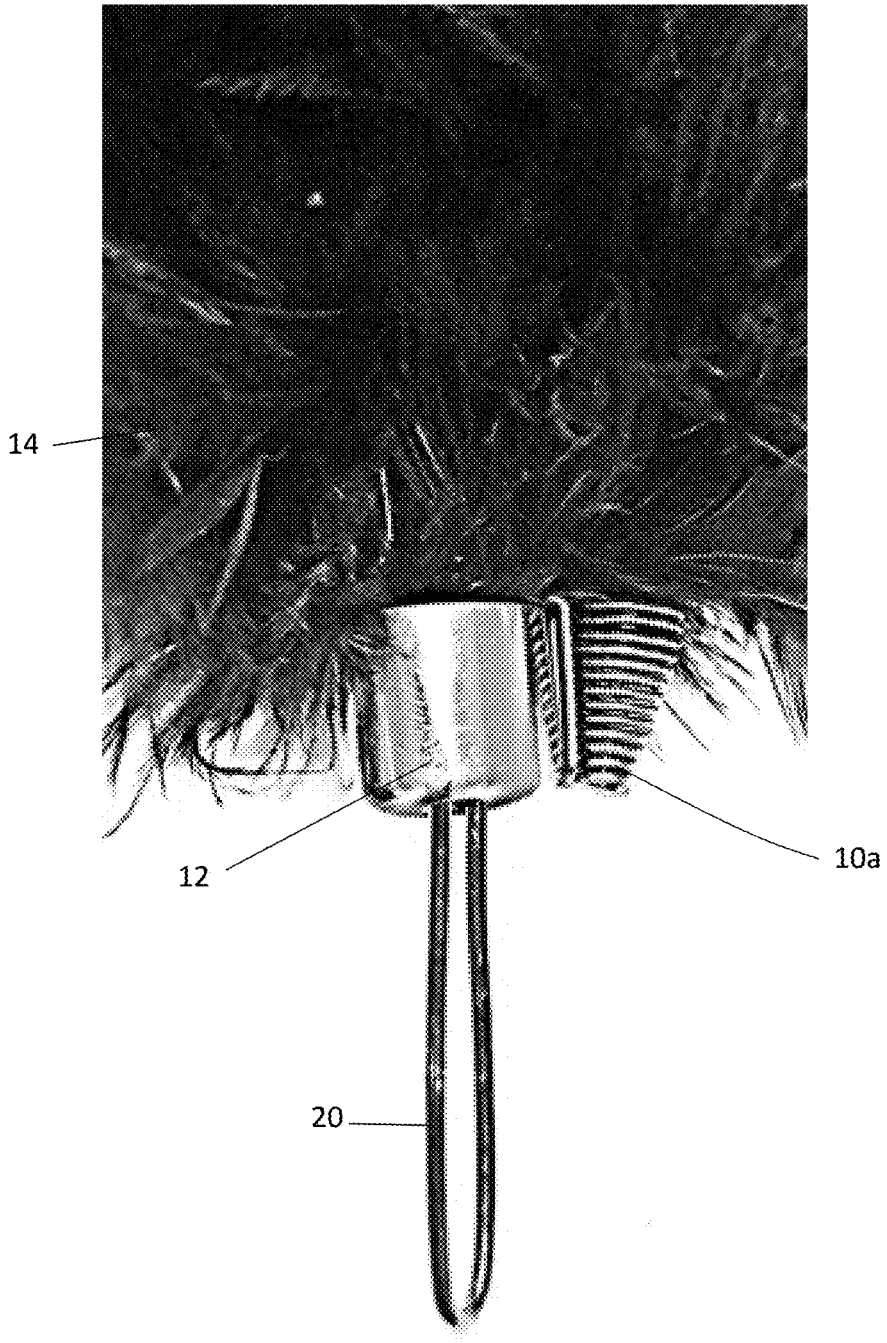
FIG. 7 is a side view of the holder releasably attached to the socket cup with the plume secured with the socket cup.
Figure 8:
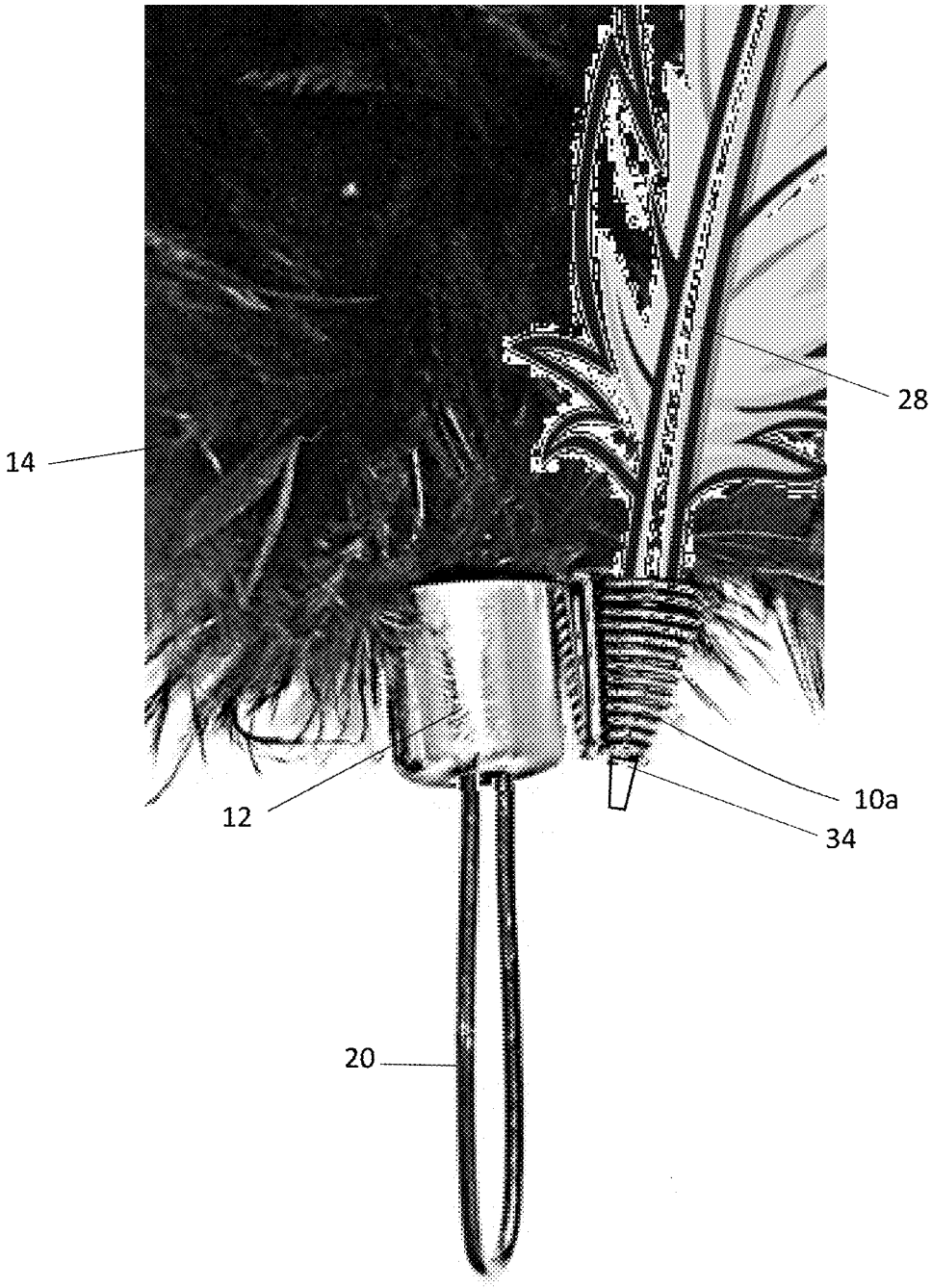
FIG. 8 is a side view of the holder releasably attached to the socket cup with a plume secured with the socket cup and an accent feather inserted in the holder.

As shown in FIG. 1, a holder 10 may be releasably attached to a conventional socket cup 12 that is configured to hold a conventional plume 14. The socket cup 12 may have a base 12*a* with a wall 12*b* extending around the base. The socket cup 12 may be releasable attached to decorative hat 16, which by way of example and not in any limiting way, may be a shako. For purposes of illustration, the decorative hat 16 may have a slot 18 on its top near the center front that may receive an anchoring assembly 19. The anchoring assembly 19 may include the socket cup 12 which holds the plume on the top of the decorative hat. The anchoring assembly 19 may further include a clip 20 that may engage a wire tie 22 of the plume 14 in an interior of the socket cup 12. The clip 20 may extend through a slot 12*c* in the base 12*b* of the socket cup 12. The clip 20 may be spring loaded against the slot 12*c* in the socket cup 12 to hold the plume 14 in place with the wire tie 22 of the plume pressed against the base 12*b* in the interior of the socket cup. The anchoring assembly 19 may further include a retainer 24. The depending portion of the clip 20 may be inserted into the retainer 24, and the retainer with the clip inserted therein may be directed through the slot 18 in the top of the decorative hat 16. The retainer 24 may be secured within the slot 18 of the decorative hat with a mechanical fastener, which may be the same fastener used to secure an emblem to the front of the decorative hat. The holder 10 may be attached to the wall 12*a* of the socket cup 12 and used to hold an accent feather (FIG. 7, '28') that may complement the plume 14. The holder 10 may be removed from the socket cup 12 when there is no longer a need to use an accent feather or it may remain in place without the accent feather. The holder 10 is configured to allow the user to interchange different accent feathers with the plume as desired, or to remove the holder as may be needed.

Figure 2:
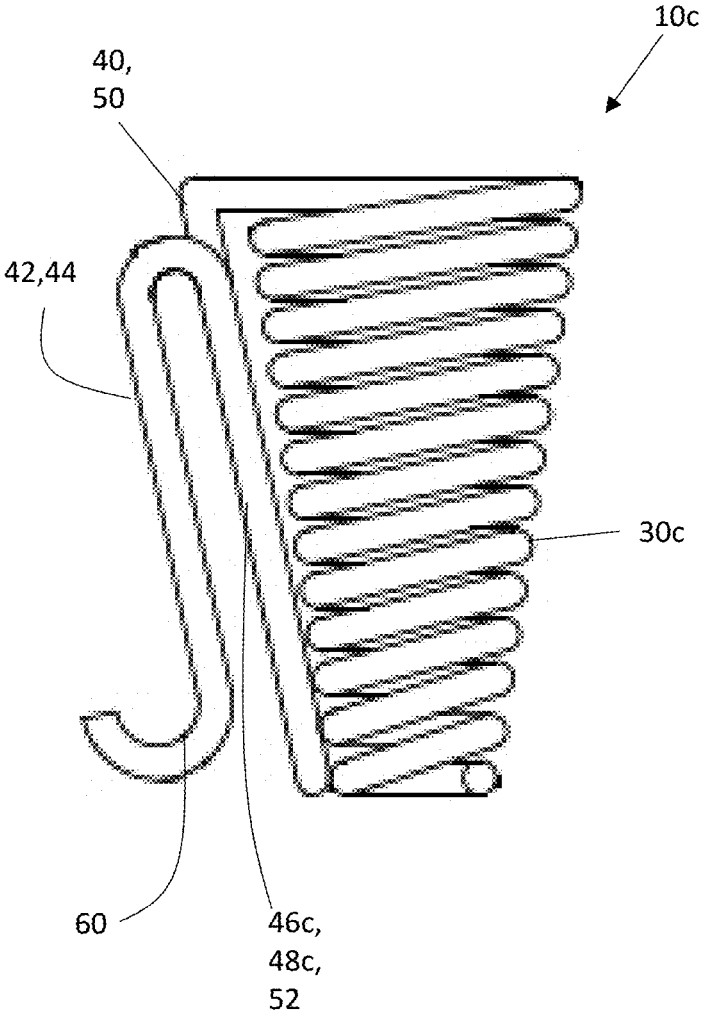
FIG. 2 is a side view of the holder of FIG. 1.
Figure 3:
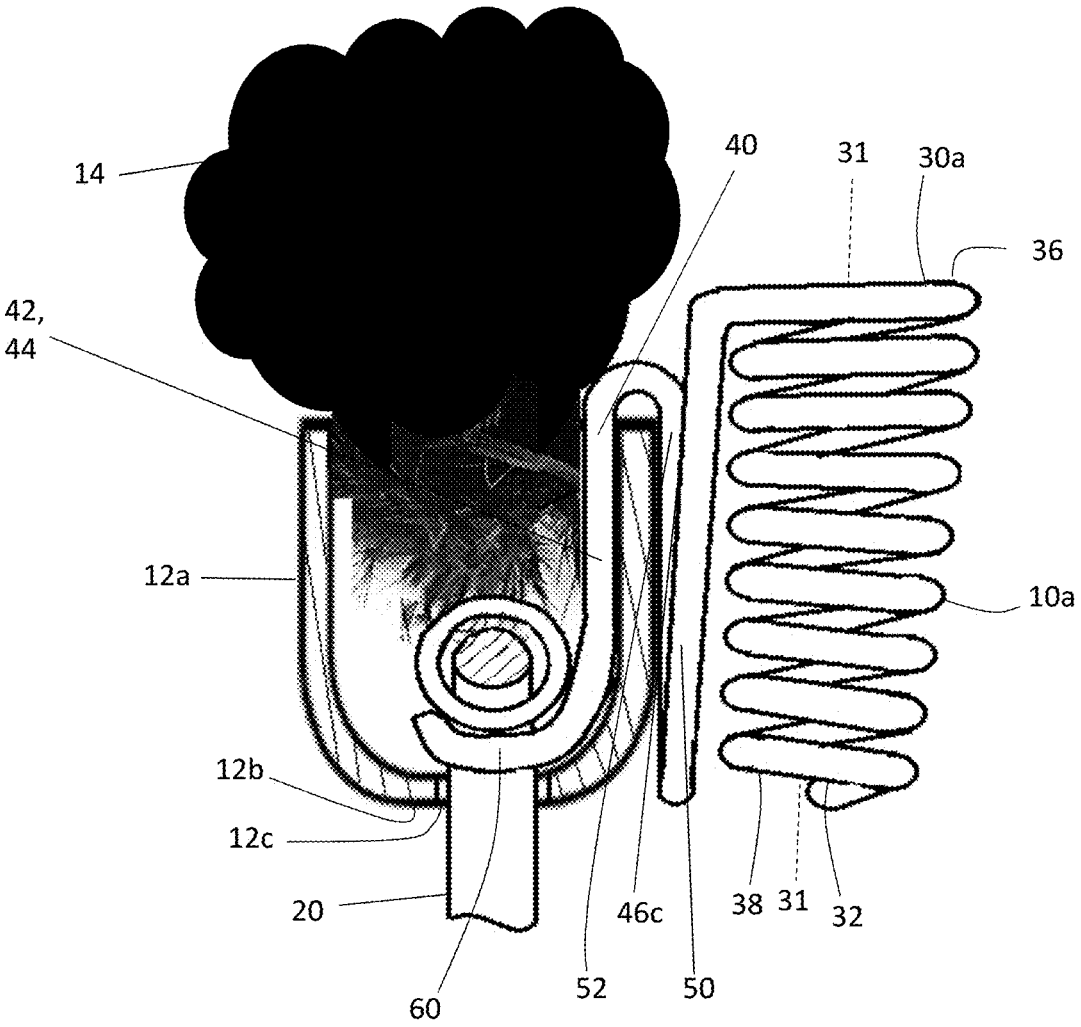
FIG. 3 is a side cross-sectional view of the holder releasably attached to the socket cup with a portion of the plume secured within an interior of the socket cup.
Figure 4:
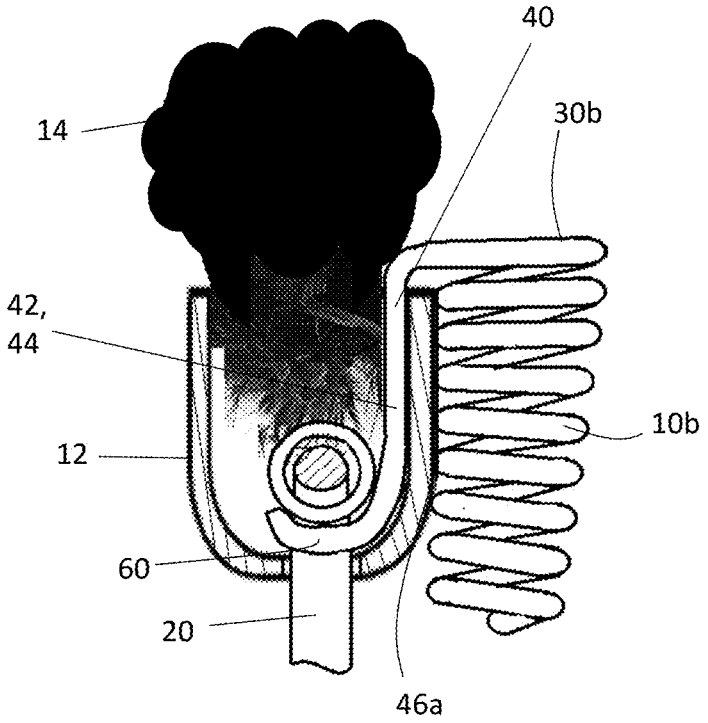
FIG. 4 is a side cross-sectional view of an alternate embodiment of the holder releasably attached to the socket cup with a portion of the plume secured with an interior of the socket cup.

FIGS. 2-4 show exemplary embodiments of the holder. The holder 10*a*,10*b*,10*c* has a coil portion 30*a*,30*b*,30*c* and a center axis 31. The coil portion has an interior 32. The interior 32 may be adapted to springingly engage a shaft 34 of the accent feather 28. The coil portion may be a helical coil and may be formed by coiling spring steel. Other materials may also be used. The coil portion may expand radially as the shaft 34 of the feather 28 is inserted therein, thus allowing the interior 32 of the coil portion to springing engage the shaft of the accent feather. The feather 28 may be rotated as it is inserted into the interior 32 of the coil portion to facilitate radial expansion of the coil portion. The feather may also be press fit in the interior 32 of the coil portion. The coil portion 30*a*,30*b*,30*c* may be conically or frusto-conically shaped. The coil portion may have a first open end 36 configured to receive the shaft 34 of the feather 28 when the feather is inserted into the coil portion along the center axis 31, and a second open end 38 axially opposite the first open end. The second open end 38 may be configured allow the shaft 34 of the feather 28 to pass therethrough when the feather is inserted into the coil portion along the center axis. The coil may also be formed to seal the end opposite the first axial open end 36.

The holder 10*a*,10*b*,10*c* has a socket cup connector portion 40 that works with the coil portion 30*a*,30*b*,30*c* to resiliently and releasably engage the wall 12*a* of the socket cup 12. The socket cup connector portion 40 extends from the coil portion 30*a*,30*b*,30*c*. The socket cup connector portion 40 may include an inner leg 42. The inner leg 42 may have a first region 44 extending in a direction axially relative to the coil portion 30*a*,30*b*,30*c* and may be generally aligned with and/or conform to an exterior 46*a*,46*b*,46*c* of the coil portion. For instance, the exterior 46*a* of the coil portion 30*a* may have a tapered shape so the first region 44 of the inner leg 42 may extend in a direction that is generally the same direction as the taper of the exterior of the coil portion. In one example, which is shown in FIG. 3, the first region of the inner leg 42 of the socket cup connector portion 40 extends from the top of the coil portion 30*a* and extends downward following the contour of the exterior 46*a* of the coil portion. Most if not all of the first region 44 of the inner leg 42 may be evenly spaced from the exterior 46 of the coil portion. The first region 44 of the inner leg 42 may also be parallel with the exterior 46*a* of the coil portion 30*a*. The spacing between first region 44 of the inner leg 42 and exterior 46*a* of the coil portion 30*a* may be arranged as needed so that when the wall 12*a* of the socket cup 12 is inserted between the first region 44 of the inner leg 42 and the exterior 46*a* of the coil portion 30*a*, the first region of the inner leg and the coil portion resiliently engage with the wall of the socket cup to maintain the holder 10 stationary on the socket cup 12 so as to support the accent feather 34 with the holder.

Figure 5:
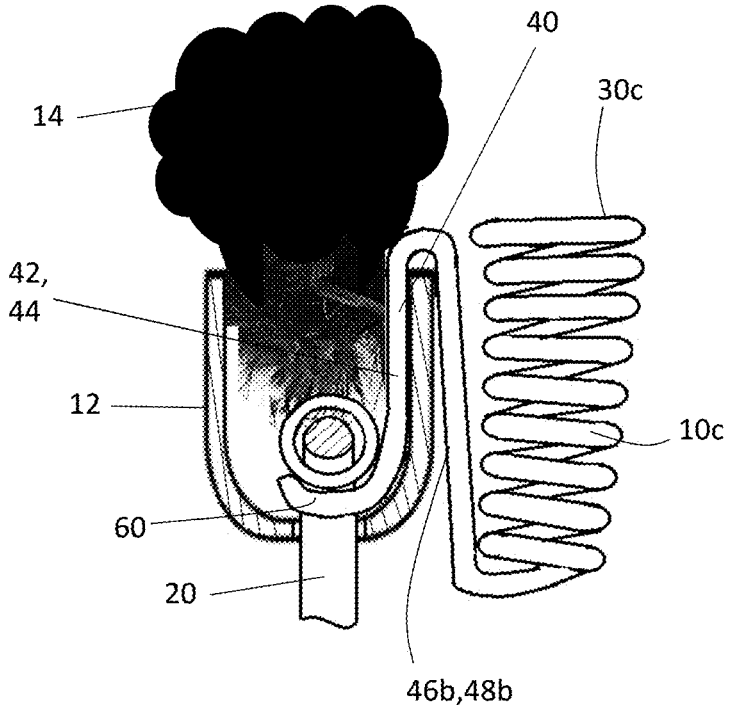
FIG. 5 is a side cross-sectional view of another alternate embodiment of the holder releasably attached to the socket cup with a portion of the plume secured within an interior of the socket cup.
Figure 6:
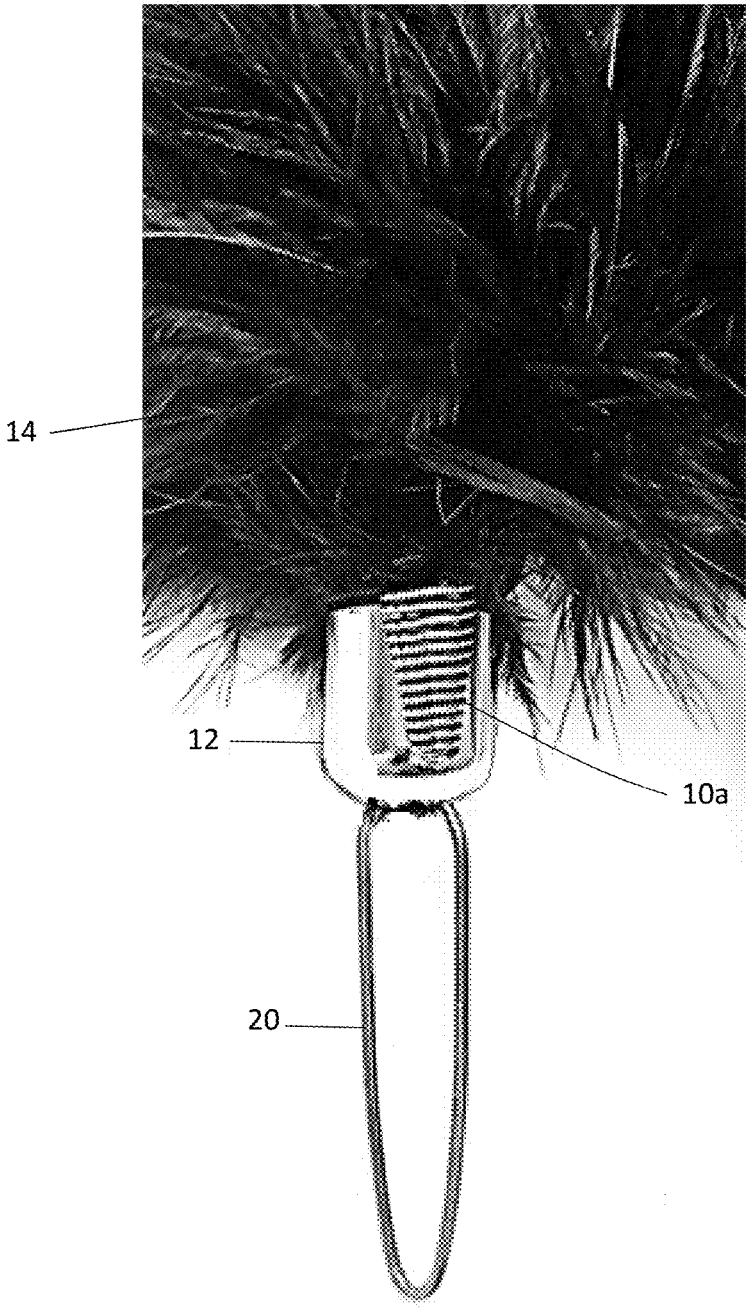
FIG. 6 is a front view of the holder releasably attached to the socket cup with the plume secured with the socket cup.

The exterior 46*b*,46*c* of the coil portion 30*b*,30*c* may include an axially extending leg 48*b*,48*c*. For instance, as shown in FIG. 5, the axially extending leg 48*b* on the exterior 46*b* of the coil portion 30*b* may extend from the bottom of the coil portion to a position generally toward the top of the coil portion before transitioning to the inner leg 42 of the socket cup connector portion 40. The axially extending leg 48*b* on the exterior 46*b* of the coil portion 30*b* may be spaced from the first region of the inner leg of the socket cup connector portion at a distance such that the coil portion axially extending leg 48*b* and first region 44 of the inner leg 42 of the socket cup connector portion 40 resiliently engage with the wall 12*a* of the socket cup when the holder is 10*b* releasably attached to the socket cup.

The axially extending leg member 48*c* may also include first and second loop members 50,52 that are positioned adjacent to each other. The first loop member 50 may extend from the coil portion 30*c* to the second loop member 52, and the second loop member 52 may extend between the first loop member 50 and the first region 44 of the inner leg 42 of the socket cup connector portion 40. For instance as shown in FIG. 2, the first loop member 50 extends from the top of the coil portion 30*c* to a position generally towards the bottom of the coil portion, and the second loop member 52 extends from a position generally at the bottom of the coil portion to a position generally towards the top of the coil portion before transitioning to the inner leg 42 of the socket cup connector portion 40. The adjacent loop members 50,52 of the axially extending leg on the exterior of the coil portion may provide improved gripping strength for the holder 10*c* on the socket cup 30 as the two loop members may better conform to the exterior of the socket cup wall 12*a* and provide two lines of contact on the socket cup wall 12*a* rather than one as may be provided by the holders 10*a*,10*b* shown in FIGS. 3-4.

The inner leg 42 of the socket connector portion 40 may also include a second region 60. The second region 60 of the socket connector portion 40 may extend in a direction away from the inner leg first region 44 and away from the coil portion 30*a*,30*b*,30*c*. The second region 60 of the inner leg 42 may be configured to engage a portion of the plume 14 when the plume is inserted in the socket cup 12. For instance, as shown in FIGS. 2-4, the second region 60 of the inner leg 42 may be arcuate, curvilinear or otherwise shaped so as to engage the clip 20 and/or the wire tie 22 of the plume 14 within the interior of the socket cup.

One may use the holder to attach an accent feather to a plume when the plume is retained by the socket cup. The user may access the holder and insert the inner leg of the socket cup connector portion into the interior of the socket cup such that the socket cup wall is disposed between the coil portion and the first region of the inner leg of the socket cup connector portion with the coil portion and the first region of the inner leg of the socket cup connector portion resiliently and releasably engaging the wall of the socket cup. In performing this step, the user may position the coil portion such that the axially extending leg of the coil portion extends axially and abuts the wall of the socket cup with the axially extending leg of the coil portion and the first region of the inner leg of the socket cup connector portion resiliently and releasably engaging the wall of the socket cup. In performing this step, the user may position the first and second loop members of the axially extending leg member in a manner to abut the wall of the socket cup wall with the first and second loop members of the axially extending leg of the coil portion and the first region of the inner leg of the socket cup connector portion resiliently and releasably engaging the wall of the socket cup. With the holder releasably attached to the socket cup, the user may insert the shaft of the accent feather into the interior of the coil portion along the center axis. When inserting the accent feather into the interior of the coil portion, the user may insert the accent feather into an open first end of the coil portion and pass a portion of the accent feather through an open second end of the coil portion. When inserting the accent feather into the interior of the coil portion, the user may insert the accent feather such that the coil portion springingly engages the shaft of the accent feather. When performing the step of inserting the inner leg of the socket cup connector portion into the interior of the socket cup such that the socket cup wall is disposed between the coil portion and the first region of the inner leg of the socket cup connector portion, the user may engage a portion of the plume with the second region of the inner leg of the socket cup connector portion. The portion of the plume may include the wire tie of the plume and/or the clip engaging the wire tie of the plume.

As various modifications could be made in the constructions and methods herein described without departing from the scope of the invention, it is intended that all matter contained in the foregoing description and shown in the accompanying drawings shall be interpreted as illustrative and not as limiting. The breadth and scope the present invention should not be limited by any of the above described exemplary embodiments.

What is claimed:

1. A method of attaching an accent feather to a plume wherein the plume is retained by a socket cup, wherein the socket cup has a wall extending around a base panel, and the wall and base panel define a hollow interior for the socket cup, the method comprising:

accessing a holder having a coil portion and a socket cup connector portion extending from the coil portion, wherein the socket cup connector portion has an inner leg, the inner leg has a first region extending axially relative to the coil portion, the inner leg has a second region extending in a direction away from the inner leg first region and the coil portion, inserting the inner leg of the socket cup connector portion into the interior of the socket cup such that the socket cup wall is disposed between the coil portion and the first region of the inner leg of the socket cup connector portion with the coil portion and the first region of the inner leg of the socket cup connector portion resiliently and releasably engaging the wall of the socket cup; and inserting a shaft of an accent feather into an interior of the coil portion along the center axis.

2. The method of claim 1 wherein the step of inserting the inner leg of the socket cup connector portion into the interior of the socket cup includes positioning the coil portion such that an axially extending leg of the coil portion extends axially and abuts the wall of the socket cup with the axially extending leg of the coil portion and the first region of the inner leg of the socket cup connector portion resiliently and releasably engaging the wall of the socket cup.

3. The method of claim 2 wherein the step of positioning the coil portion such that the axially extending leg of the coil portion extends axially and abuts the wall of the socket cup with the axially extending leg of the coil portion and the first region of the inner leg of the socket cup connector resiliently and releasably engaging the wall of the socket cup includes positioning first and second loop members of the axially extending leg member in a manner to abut the wall of the socket cup wall with the first and second loop members of the axially extending leg of the coil portion and the first region of the inner leg of the socket cup connector portion resiliently and releasably engaging the wall of the socket cup.

4. The method of claim 1 wherein the step of inserting the accent feather into the interior of the coil portion includes inserting the accent feather into an open first end of the coil portion and passing a portion of the accent feather through an open second end of the coil portion, wherein the second open end is axially opposite the first open end.

5. The method of claim 1 wherein the step of inserting the accent feather into the interior of the coil portion includes inserting the accent feather such that the coil portion springingly engages the shaft of the accent feather.

6. The method of claim 1 wherein the step of inserting the inner leg of the socket cup connector portion into the interior of the socket cup such that the socket cup wall is disposed between the coil portion and the first region of the inner leg of the socket cup connector portion includes engaging a portion of the plume with the second region of the inner leg of the socket cup connector portion.

* * * * *